US005561439A

United States Patent [19]

Moilanen

[11] Patent Number: 5,561,439

[45] Date of Patent: Oct. 1, 1996

[54] CAR PHONE ANTENNA

[75] Inventor: Mikko K. Moilanen, Halikko, Finland

[73] Assignee: Nokia Mobile Phones Limited, Salo, Finland

[21] Appl. No.: 519,131

[22] Filed: Aug. 24, 1995

Related U.S. Application Data

[63] Continuation of Ser. No. 154,264, Nov. 18, 1993, abandoned.

[30] Foreign Application Priority Data

Dec. 22, 1992 [FI] Finland ..... 925831

[51] Int. Cl.[6] ..... H01Q 1/48

[52] U.S. Cl. ..... 343/846; 343/745; 343/773; 343/830

[58] Field of Search ..... 343/846, 790, 343/745, 881; H01Q 1/36, 7/08

[56] References Cited

U.S. PATENT DOCUMENTS

| | | | |
|---|---|---|---|
| 2,168,860 | 8/1939 | Berdet | 343/830 |
| 2,659,002 | 11/1953 | Keeler | 343/790 |
| 3,264,647 | 8/1966 | Nuttle | 343/745 |
| 3,293,646 | 12/1966 | Brueckmann | 343/830 |
| 3,474,453 | 10/1969 | Ireland | 343/745 |
| 3,787,865 | 1/1974 | MacDowell et al. | 343/861 X |
| 3,919,710 | 11/1975 | Fletcher et al. | 343/770 |
| 4,179,698 | 12/1979 | Liautaud | 343/715 |
| 4,224,625 | 9/1980 | Peretz et al. | 343/750 |
| 4,520,363 | 5/1985 | Wachspress et al. | 343/830 X |
| 4,543,584 | 9/1985 | Leer | 343/881 |
| 4,851,859 | 7/1989 | Rappaport | 343/790 |
| 5,132,698 | 7/1992 | Swineford | 343/846 |

FOREIGN PATENT DOCUMENTS

0346315A3 12/1989 European Pat. Off. .

OTHER PUBLICATIONS

RCA Technical Notes, No. 1337, Nov. 1983, Princeton, U.S. Robert M. Wilson, "Line Cord Antenna With Coaxial Section".

Finnish Office Action dated 17 Sep. 1993, Patent Application No. 925831 English Translation of Finnish Office Action.

*Primary Examiner*—Donald T. Hajec
*Assistant Examiner*—Tho Phan
*Attorney, Agent, or Firm*—Perman & Green

[57] ABSTRACT

An antenna comprises a radiating element and a cone-shaped ground plate the relative distance between which can be altered thus altering the resonant frequency of the antenna and a base. The resulting antenna is a wideband quarter-wave vertical antenna which can be employed for testing in the 1.8 GHz frequency range and for temporary use in all car phones as well as in fixed stations.

11 Claims, 2 Drawing Sheets

CAR PHONE ANTENNA

This is a continuation of application Ser. No. 08/154,264 filed on Nov. 18, 1993, now abandoned.

The invention relates to an antenna for a car phone.

BACKGROUND OF THE INVENTION

Car phone antenna according to the prior art, which are used in testing in the 1.8 GHz frequency range, are not user friendly. They are very difficult to install and require a ground plate. In addition, their resonance frequency and radiation pattern as well as the impedance of the input point vary due to differences in installation methods.

SUMMARY OF THE INVENTION

According to the present invention there is provided an antenna comprising a radiating element and a conducting ground plate, characterized in that the ground plate and the radiating element are mechanically coupled via an adjustable element which is disposed between the radiating element and the ground plate such that by manipulation of the adjustable element the position of the radiating element relative to the ground plate can be adjusted, thereby enabling the antenna's resonance frequency to be altered.

The wideband quarter-wave vertical antenna in accordance with the invention can be employed for testing in the 1.8 GHz frequency range and for temporary use in all car phones as well as in fixed stations.

An advantage of the present invention is the provision of an antenna for car phones, which operates in the 1.8 GHz frequency range and offers a way of solving or mediating the above-presented deficiencies and problems.

Preferably the impedance of the antenna's input point can be adjusted to a constant level by means of a ground plate in the form of a truncated cone.

Also preferably the truncated cone-shaped ground plate extends substantially away from the radiating element, the lower part of the radiating element forming a connection means which extends into the truncated cone.

The connection means is provided with adjustment means by the manipulation of which the relative distance between the radiating element and the ground plate can be adjusted.

The ground plate and antenna are releasably connected to a magnetic base by lockable attachment means.

The antenna is attached to the magnetic base in such a way that the antenna equipped with a magnetic base can easily be installed, for example, on a car roof. Also, the resonance frequency can be set to the desired level by manipulating the adjustable element, and the antenna's radiating element and the cone-shaped ground plate can be easily attached to the magnetic base by means of an attachment element.

BRIEF DESCRIPTION OF THE DRAWINGS

An embodiment of the present invention will now be described, by way of example, with reference to the accompanying drawings, in which.

DETAILED DESCRIPTION OF THE INVENTION

Figure 1:
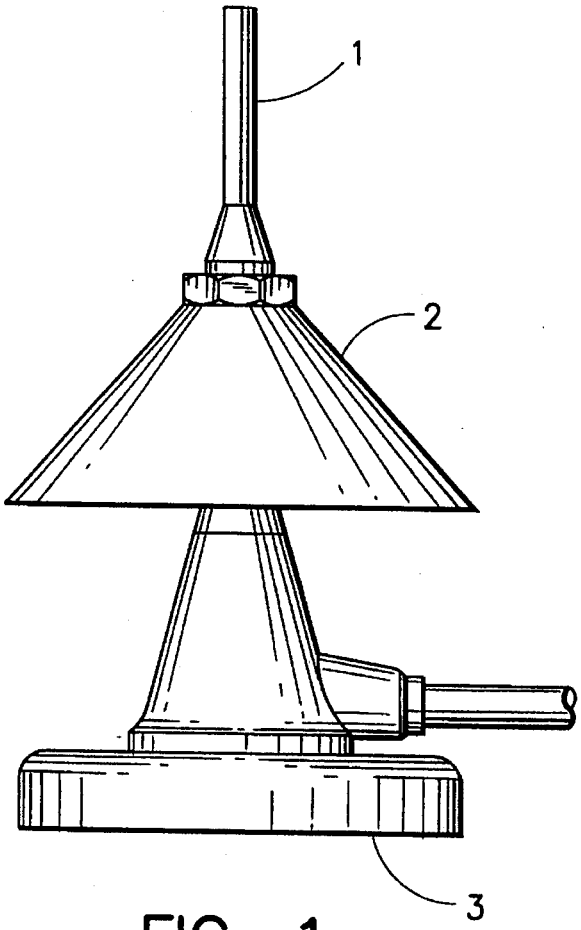
FIG. 1 presents the construction of an antenna for a car phone accordance with the invention.

FIG. 1 presents the construction of a car phone antenna in accordance with the invention. The antenna comprises a radiating element 1 and a cone-shaped ground plate 2. In FIG. 1 the antenna has been installed on a magnetic base 3. The antenna equipped with the magnetic base 3 according to FIG. 1 can be easily installed, for example, on a car roof by merely placing the magnetic base 3 on the car roof once the antenna and ground plate have been attached to the magnetic base 3.

Figure 2:
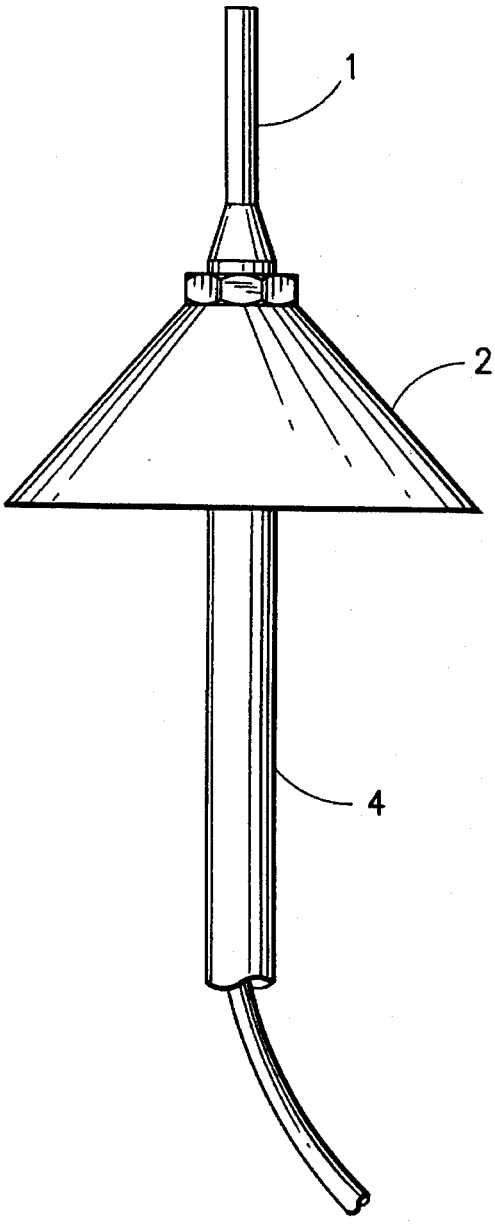
FIG. 2 presents an alternative mode of installation of the antenna of FIG. 1.

FIG. 2 presents an alternative mode of installation of the car phone antenna in accordance with the invention. In the alternative mode of installation, the antenna comprises a base tube 4 in addition to the radiating element 1 and the cone-shaped ground plate 2. An antenna equipped with the base tube 4 can be used, for example, in a fixed station.

Figure 3:
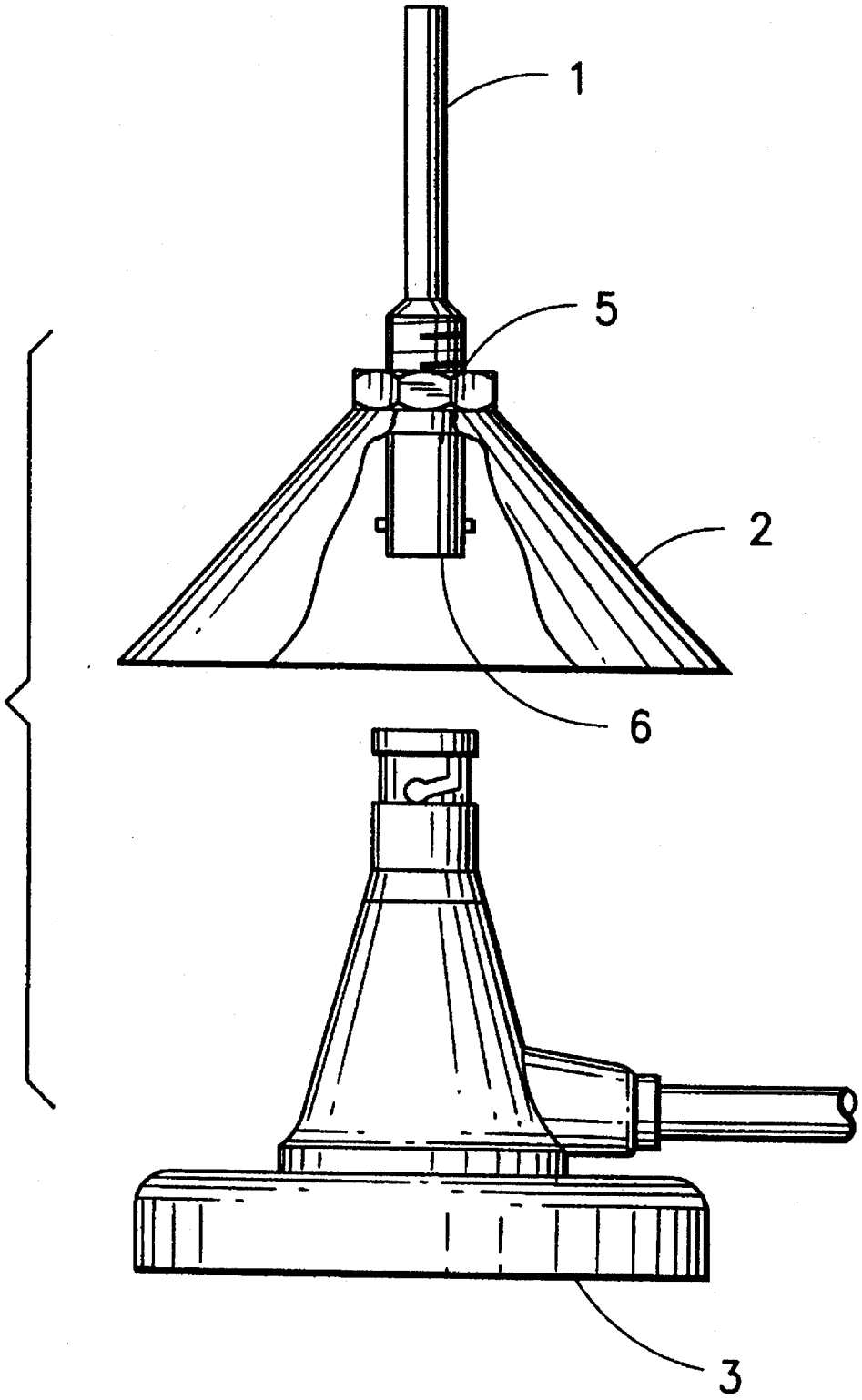
FIG. 3 presents the detailed construction of the antenna of FIG. 1.

FIG. 3 presents the detailed construction of the car phone antenna in accordance with the invention. The antenna comprises an adjusting element 5 between the radiating element 1 and the cone-shaped ground plate 2; in this case, the adjusting element 5 is a nut which has a corresponding thread to that of the threaded part of element 1 and can be manipulated so as to set the resonance frequency to the desired level by relative movement of the antenna with respect to the ground plate 2. The antenna also comprises an attachment element 6 by means of which the antenna's radiating element 1 and the cone-shaped ground plate 2 can easily be attached to the magnetic base 3.

The antenna in accordance with the invention operates without a separate ground plate because its cone-shaped element 2 functions as a ground plate. The impedance of the input point of the antenna according to the invention can be adjusted to a constant level (for example, 50 ohms) by means of the cone-shaped ground plate 2.

In view of the foregoing it will be clear to a person skilled in the art that modifications may be incorporated without departing from the scope of the present invention.

What I claim is:

1. An antenna comprising a conducting ground plate having a frustoconical shape, a radiating element having a rod shape and extending away from the ground plate in a first direction, an adjusting element which is disposed between the radiating element and the ground plate, and mounting means extending away from the ground plate in a second direction opposite the first direction for supporting the antenna;

wherein the mounting means comprises coaxial attachment means connecting with the ground plate and the radiating element, and the adjusting element is disposed on a frustoconical portion of the ground plate; and wherein the adjusting element contacts said radiating element, and is operative mechanically to displace the radiating element relative to the ground plate with a resulting alteration of a resonance frequency of the antenna.

2. An antenna as claimed in claim 1, wherein the antenna has an input impedance, and the ground plate has the form of a truncated cone for adjusting the input impedance to a constant level.

3. An antenna as claimed in claim 1, wherein the ground plate is a truncated cone-shaped ground plate and extends substantially away from the radiating element, a lower part of the radiating element forming a connection means which extends into the truncated cone to connect with the attachment means.

4. An antenna as claimed in claim 3, wherein part of the connection means is provided with adjustment means, the adjustment means cooperating with the adjusting element for adjusting the distance between the radiating element and the ground plate.

5. An antenna as claimed in claim 4, wherein the adjustment means comprises a screw thread, and the adjusting element comprises a threaded nut complementary to the screw thread and located at the ground plate, the screw thread mating with the threaded nut.

6. An antenna as claimed in claim 1, further comprising a magnetic base for supporting the ground plate and the radiating element.

7. An antenna as claimed in claim 6, wherein the attachment means is lockable, and wherein the ground plate and the radiating element are releasably connected to the magnetic base by the lockable attachment means.

8. An antenna as claimed in claim 7, wherein the attachment means is in the form of a coaxial bayonet fitting.

9. An antenna as claimed in claim 1, wherein the mounting means further comprises a base tube extending downwards from the ground plate.

10. An antenna as claimed in claim 1 wherein the radiating element faces an exterior surface of the ground plate and the mounting means faces an interior surface of the ground plate.

11. An antenna as claimed in claim 10 wherein the radiating element is coaxial to the ground plate.

* * * * *